US006022648A

United States Patent [19]

Jacobson et al.

[11] Patent Number: 6,022,648

[45] Date of Patent: Feb. 8, 2000

[54] BISTABLE, THERMOCHROMIC RECORDING METHOD FOR RENDERING COLOR AND GRAY SCALE

[75] Inventors: Joseph M. Jacobson, Cambridge; V. Michael Bove, Jr., Wrentham, both of Mass.

[73] Assignee: Massachusetts Institute of Technology, Cambridge, Mass.

[21] Appl. No.: 08/614,830

[22] Filed: Mar. 8, 1996

[51] Int. Cl.[7] ..... G03C 7/00; B41M 5/34

[52] U.S. Cl. ..... 430/19; 430/22; 430/333; 430/964; 430/334; 347/172; 347/232; 347/248; 347/250; 503/204; 503/227

[58] Field of Search ..... 430/19, 333, 339, 430/964, 22, 334; 503/204, 227; 347/172, 183, 221, 232, 240, 256, 262, 264, 248, 250

[56] References Cited

U.S. PATENT DOCUMENTS 4,717,710 1/1988 Shimizu et al. .
4,720,450 1/1988 Ellis ..... 430/339
4,956,251 9/1990 Washizu et al. .
5,178,669 1/1993 Watanabe et al. .
5,274,460 12/1993 Yamada et al. .
5,409,797 4/1995 Hosoi et al. .
5,432,534 7/1995 Maruyama et al. .
5,470,816 11/1995 Satake et al. .
5,480,482 1/1996 Novinson .
5,585,320 12/1996 Tsutsui et al. ..... 503/204

*Primary Examiner*—John A. McPherson
*Attorney, Agent, or Firm*—Cesari & McKenna, LLP

[57] ABSTRACT

Thermochromic materials are incorporated into constructions that facilitate accurate reproductions of monochrome or full-color images having multiple gray levels. The invention utilizes thermochromic materials having different transition temperatures to facilitate their selective activation. The materials may be located in a single layer of a recording sheet, or in multiple layers. The invention also comprises thermal printing apparatus useful in imaging the foregoing constructions, particularly those exhibiting hysteresis.

11 Claims, 4 Drawing Sheets

BISTABLE, THERMOCHROMIC RECORDING METHOD FOR RENDERING COLOR AND GRAY SCALE

FIELD OF THE INVENTION

The present invention relates to thermal printing, and more particularly to gray-scale and full-color printing with bistable, thermochromic imaging materials.

BACKGROUND OF THE INVENTION

Thermal printing systems are well known and widely used in applications such as facsimile printers, ticket printers and similar devices. Like most printing technologies, thermal printing is irreversible; the printed image is permanent, and neither the substrate nor the ink can be reused.

A number of compounds have been identified for producing inks that may be reversibly colored upon application of heat energy or cooling energy, and which are "bistable": once placed into one or the other state (e.g., transparent or colored), the substance exhibits hysteresis, tending to persist in that state under ordinary ambient conditions. These compounds broadly include low molecular-weight systems, leuco dye systems, lactone-ring systems and urea systems, and fall into two broad categories: materials that are both writable (colored) and erasable (transparent) through heating to different temperatures or with different heat cycles; and materials that require heating and cooling to write and erase. These categories are not always mutually exclusive. Because the compounds tend to exhibit temperature hysteresis and can be formulated to undergo state change at varying transition temperatures, the same chemical system may behave in either fashion depending on the manner of preparation.

For example, U.S. Pat. No. 5,274,460 (to Yamada et al.), the entire disclosure of which is hereby incorporated by reference, describes systems that include a leuco dye, a developing/tone-reducing agent adapted to thermally react with the dye to effect development or tone reduction, and a suitable binder. Exposure of the system to a first thermal energy level (e.g., heating to a high temperature of 200–350° C. for a short duration of 1–3 msec) produces a color, while exposure to a second thermal energy level (e.g., heating to a low temperature of 80–150° C. for a longer duration of 5 msec to 2 sec) renders the system transparent. The developing/tone-reducing agent is a substance having, in the same molecule, a group that exhibits a thermally triggered color-developing property with respect to the leuco dye, and a group that exhibits a thermally triggered tone-reducing property with respect to the leuco dye. The agent may be a salt of a phenolic carboxylic acid and an organic amine, which can be thermally induced to behave as an acid or a base. Under acidic conditions, the lactone rings of the leuco dye open and the molecule becomes colored; exposure to basic conditions closes the rings and restores the original colorless state. See also U.S. Pat. No. 5,178,669.

Other examples of materials that facilitate reversible, bistable recording and erasure through heating to different temperatures include systems using dimerized or trimerized urea developers, as disclosed in U.S. Pat. No. 5,470,816 (to Satake et al.); and the systems disclosed in U.S. Pat. No. 5,432,534 (to Maruyama et al.), which include a thermally sensitive coloring agent such as a triphenylmethane phthalide compound, a fluoran compound, a phenothiazine compound, a leuco auramine compound or a indolinophthalide compound, and a color developer such as a phosphoric acid compound, an aliphatic carboxylic compound or a phenolic compound. The entire disclosures of both of these references are hereby incorporated by reference.

U.S. Pat. No. 5,480,482 (to Novinson), incorporated by reference herein, discloses compounds of the second type, that is, which are alternately heated or cooled to effect erasure or writing. In particular, the '482 patent discloses a pigment mixture including (a) a colorless cyclic aryl lactone dye that undergoes ring opening to form a colored triarylmethylene carboxylic acid dye, (b) an alkaline activator agent that effects ring opening of the dye when the mixture is heated and ring closure to the colorless lactone state when the mixture is cooled, and (c) a low-melting solid that functions as a solvent and activator. Generally, the dye is rendered colorless through heating to temperatures of 30–70° C., and colored through cooling to temperatures below 25° C. Thus, the mechanism is analogous to that described in the '460 and '669 patents, but the different transition temperatures result in functionally different behavior.

One mechanism for systematically modulating the transition temperature within a range of possibilities involves selective formulation of the low-melting solvent. In solid form, the solvent immobilizes the various reactants, preventing or impeding reaction and consequent transition of the dye between colored and transparent states. Thus, if the solvent melting point is higher than the normal transition temperature of the dye, the transition temperature of a pigment made by combining the dye and the solvent into a particle will be the melting point of the solvent. Hysteresis can be achieved, for example, if the product of the forward reaction (e.g., a ring-opened lactone dye) depresses the freezing point of the solvent to a greater degree than does the product of the reverse reaction (e.g., the closed-ring lactone dye). In this case, following melting of the solvent and occurrence of the forward reaction, the composition must be cooled to a temperature below the previous melting point to achieve solvent solidification. So long as the reverse reaction takes place above this depressed solidification temperature, it will occur prior to renewed reactant immobilization.

In U.S. Pat. No. 4,717,710, the entire disclosure of which is hereby incorporated by reference, a thermochromic composition comprising an electron-donating chromogenic material, a 1,2,3-triazole compound and a weakly basic, sparingly soluble azomethine or carboxylic acid primary amine salt are combined with a solvent such as stearic acid glyceride, lanolin, diphenylphthalate, lauric acid glyceride, propyl laurate or palmitic acid glyceride. Depending on the solvent chosen, the transition temperature can occur over a wide range from about −40° C. to about 150° C.

To the extent these reversible compounds have been used in computer printing applications, it has been in the traditional manner without multiple colors and without gray scale. Most computer-driven printing devices, such as laser, dot-matrix and ink-jet printers, print in a binary fashion: the output medium is divided into an array of picture elements, or "pixels," and the devices can either print a small colored dot at each pixel location or leave the location blank. In the case of monochrome printers, all of the dots are printed in a single color, whereas color printers select a dot color from a small set of colors.

Pictorial imagery, by contrast, is continuous in tonality, exhibiting a "gray scale" that extends over a large range of tonal levels. If such a "continuous-tone" image is divided into pixels, each will exhibit a gray-scale tone. In order to reproduce the image by means of an electronic printing device capable of applying only a single-toned dot, these gray-scale tones must be converted into a binary format. The conversion process, which may take many forms, is generically referred to as "halftoning." A halftone image consists solely of a spatial arrangement of binary colored or uncolored dots, but the human visual system integrates this pattern to create an illusion of a continuous-tone original. Because information is always lost, however, a halftoned image inevitably exhibits visual distortions due to "quantization error" (i.e., the difference between the input tonal value represented by a multibit word and the output value represented by a single bit) wherever the original image contains gray values; in an 8-bit gray scale, for example, such error is absent only at signal levels of 0 or 255.

DESCRIPTION OF THE INVENTION

BRIEF SUMMARY OF THE INVENTION

In accordance with the invention, thermochromic materials are incorporated into constructions that facilitate accurate reproductions of monochrome or full-color images having multiple gray levels. (In the case of a colored image, the terms "gray levels" and "gray scale" are used to connote multiple densities of a single color.) The recording constructions include thermochromic materials that are present as solubilized dyes, as microencapsulated dyes, or as particles (e.g., comprising a dye mixed with a fusible solvent and fabricated in particulate form); as used herein, the term "pigment" includes any particulate form of thermochromic material, whether or not the thermochromic composition utilizes a dye to impart color, and the term "composition" is used generically to connote both pigment and dye forms. The thermochromic composition is dispersed into a hardenable material capable of accepting, in a liquid or molten state, a dispersion or solution of the thermochromic composition, and which may then be coated or laminated onto a sheet support to serve as a recording layer. It should be stressed that the thermochromic composition, while ordinarily dispersed into the hardenable material as an even (e.g., colloidal) dispersion, can also dissolved therein if soluble; the term "dispersion" is therefore used generically to connote both dispersion of insoluble particulate material and solutions. Generally, the thermochromic compositions of the present invention exhibit hysteresis, retaining an externally imposed transition at room temperature without spontaneous reversion to the previous state.

In a first aspect, the invention comprises recording constructions facilitating reproduction of images having multiple gray levels, and methods of imaging such constructions. In one embodiment, the construction comprises a plurality of recording layers each containing a dispersion of a thermochromic recording material which, while similar in color to the other layers, exhibits a transition temperature different from those of the other layers. The number of such layers corresponds to the number of gray scales that the recording member is capable of rendering. The construction is imaged by applying heat in an imagewise pattern, the amount of heat applied at any point determining the number of layers affected, and therefore the level of gray that will appear at that point.

In another embodiment, the differently responsive thermochromic materials are located in a single layer rather than different layers. The method of imaging is the same, however, since each thermochromic composition is differently responsive, and once again the amount of heat applied determines the gray level of the affected region.

In a second aspect, the invention comprises recording constructions facilitating reproduction of images having multiple colors and, if desired, multiple gray levels in one or more of the colors, as well as methods of imaging such constructions. In one embodiment, the construction comprises a series of recording layers one atop the other, each containing a dispersion of a thermochromic recording material of a different color; the colors collectively form a subtractive color gamut. Underlying the bottommost recording layer is a reflective or white substrate. The construction is imaged by selective exposure to light complementary to the various colors, exposure of a given thermochromic material to light of its complementary color heating the material to its transition point while leaving the differently colored thermochromic materials unaffected. In a variation to this embodiment, each color is represented by more than one thermochromic composition having a different transition temperature (and located in the same or adjacent layers). In this way, a gray scale is introduced into each color for which multiple thermochromic compositions are used, since more intense exposure will cause greater heating and consequent transition of an increased number of the compositions.

In another embodiment, the differently colored thermochromic materials are combined into a single layer, only in this case the colors form an additive color gamut. The approach to imaging is analogous, however; exposure to light complementary to a particular color results in transition of that color, and imagewise exposure is used to impart a desired image. Once again, gray levels can be added to this embodiment by varying the transition temperatures of the different colors.

In a variation to this embodiment, the colors are not mixed into a single layer, but are instead located in separate, contiguous, monochrome stripes organized according to the color gamut; for example, in a red/green/blue color gamut, the stripes are arranged in red, green and blue triplets. The stripes are sufficiently narrow that the eye visually integrates them, and are imaged by causing selective, imagewise transition of the stripes in an imagewise pattern.

In another aspect, the invention comprises thermal printing apparatus useful in imaging the foregoing constructions, particularly those exhibiting hysteresis. The apparatus includes a conventional paper feeding and conveying mechanism that conducts a sheet of paper to first and second heating or cooling elements, which condition the sheet to eradicate spurious or remnant hysteresis. The conditioned sheet is then engaged to a rotating drum, where it is selectively exposed to the action of a variable-temperature thermal writing head (in one embodiment) or a scanner capable of imagewise application of colors complementary to those used in the construction. In either case, operation is ultimately controlled by an incoming stream of picture signals, which constitute an electronic representation of an original document or picture.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
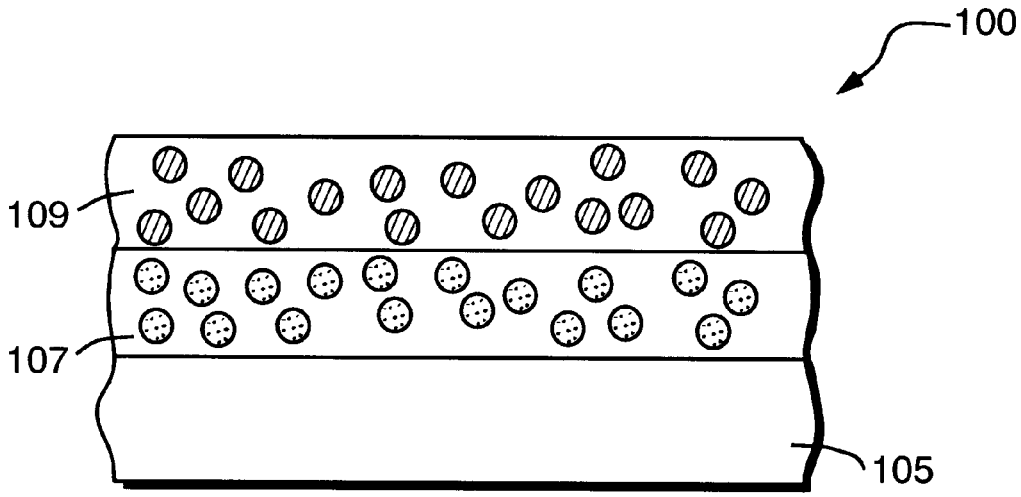
FIG. 1 is an enlarged sectional view showing a multilayer recording member capable of rendering multiple gray-scale levels (with pigment particles substantially enlarged for purposes of presentation)
Figure 2:
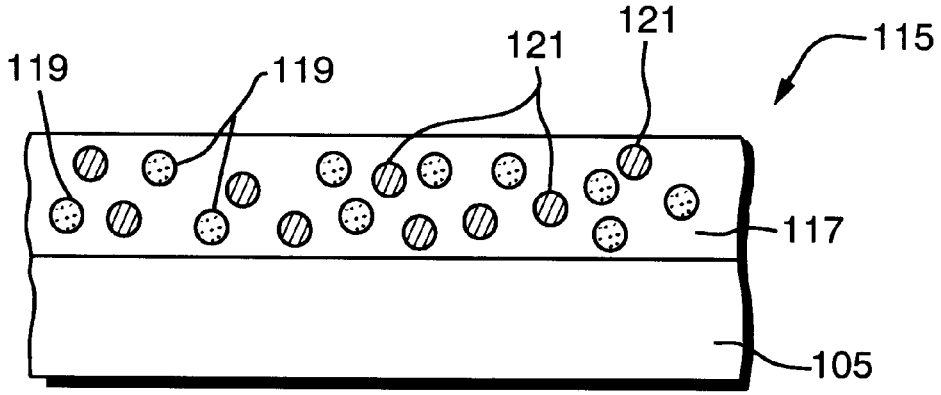
FIG. 2 is an enlarged sectional view showing a single-layer recording member capable of rendering multiple gray-scale levels.

Refer first to FIGS. 1 and 2, which illustrate recording constructions that facilitate production of gray-scale images. In the embodiment shown in FIG. 1, a construction 100 includes a bottommost substrate layer 105 and a plurality of recording layers shown representatively at 107, 109, each such layer containing a dispersion of a thermochromic composition having a transition temperature different from that of the other layers. The number of layers corresponds to the number of gray scales that the recording member 100 is capable of rendering.

Substrate 105 can be any material capable of supporting the overlying recording layers and can include, for example, paper, synthetic paper, a plastic film (e.g., polyester), or a plastic-paper composite. Substrate 105 ordinarily provides the image background and is, therefore, typically white. If desired, substrate 105 can reflect incident radiation to enhance overall appearance.

Layers 107, 109 are formed from a hardenable material capable of accepting, in a liquid or molten state, a dispersion (or solution) of the thermochromic composition described below. Generally, a cross-linkable plastic or binder resin is mixed with the thermochromic composition and a solvent prior to curing so as to produce a stable dispersion (or solution), which is then coated onto substrate 105 or an overlying recording layer. The composition is then cured (e.g., by exposure to actinic radiation, an electron beam, etc.) and any solvent driven off to produce an infusible "thermoset" polymer that freezes the dispersion and resists degradation from the heat applied to cause thermochromic transitions. Suitable dispersion-accepting, curable polymeric materials can include, for example, acrylates, methacrylates, polyvinyl chloride, polyvinyl acetate, polystyrene, phenoxy resins, polyesters, polyurethanes, polycarbonates, polyvinyl alcohols, and various copolymers of the foregoing.

The thermochromic material may be introduced as a solubilized dye or, preferably, dispersed as a pigment. The pigment particles may be formed from thermochromic dyes through microencapsulation using conventional methods (such as the coacervation method, the interfacial polymerization method, or the in-situ polymerization method), or by combining a dye with a low-melting solid as contemplated in the '482 patent and dispersing the solidified material in particulate form. Suitable thermochromic dyes are set forth, for example, in the '710 and '482, patents, and should exhibit hysteresis such that transitions persist at room temperature (~68° F.). Generally, the transition temperatures of the different layers are 1–10° C. apart from one another, although the necessary temperature spacing naturally depends on the material being used; those with sharper reaction-temperature profiles can be spaced more closely than materials exhibiting more gradual profiles.

In operation, a heat source applies heat to the recording member 100 in an imagewise pattern, the amount of heat applied at any point determining the level of gray that will appear at that point. For example, with reference to FIG. 1, suppose that the pigment dispersed in layer 107 requires a higher transition temperature than that dispersed in layer 109. Pointwise application of heat sufficient to cause transition of layer 107 (e.g., from a colored to a transparent state) will necessarily also cause transition of the overlying layer 109. On the other hand, sufficient heat to cause transition of layer 109 need not cause transition of layer 107. Because the visual effect of the various layers is cumulative, image regions where all recording layers are colored appear darkest, while removing color from successive recording layers renders the image correspondingly lighter. Thus, while each layer is either "on" or "off" (fully colored or fully transparent) at any image point, various levels of gray can nonetheless be rendered.

If the recording member 100 is heated to one state and cooled to the other, it is preferably imaged using the imaging apparatus described hereinbelow. If the member 100 is instead exposed to different temperatures (for suitable times) to cause transitions, any conventional, digitally addressable thermal writing head can be used. During the imaging process, relative movement is caused between the writing head and the recording member (e.g., with the recording member affixed to a rotatable drum and the writing head mounted on a bracket configured for movement along a lead screw, the writing head passing over a column of image points before being indexed to the next column by a stepper motor; or with the recording member affixed to a flatbed recorder and the writing head mounted to brackets that may be indexed along two dimensions), and a computer causes the writing head to emit pulses at the appropriate times and of the appropriate intensities to impose an imagewise, gray-scale pattern on the recording member.

An alternative to the embodiment shown in FIG. 1 appears in FIG. 2. Instead of locating the differently responsive thermochromic materials in different discrete layers, in this embodiment they are all distributed uniformly and randomly in a single layer 117. The figure illustrates a two-level gray scale embodiment analogous to the embodiment shown in FIG. 1, with a first set of pigment particles 119 having a transition temperature different from that of a second set of pigment particles 121. Once again, the greater the heat applied to a given region of recording layer 117, the greater will be the diversity of particles within that region that undergo transition, with a correspondingly larger effect on gray scale.

Figure 3:
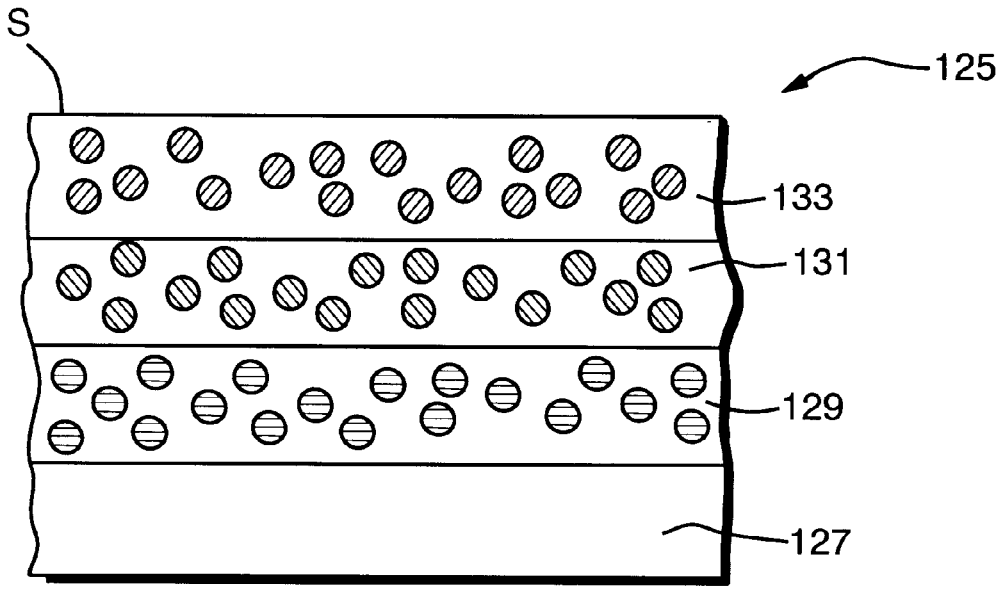
FIG. 3 is an enlarged sectional view showing a multilayer recording member capable of rendering color.
Figure 4:
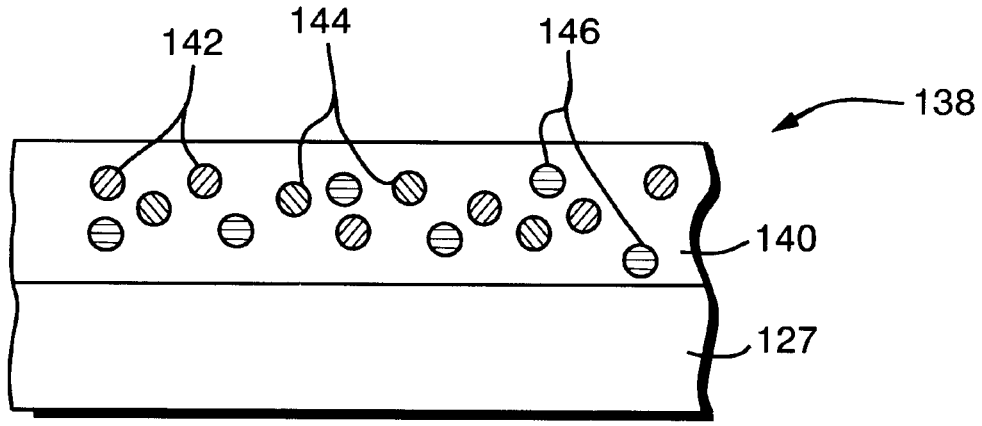
FIG. 4 is an enlarged sectional view showing a single-layer recording member capable of rendering color.
Figure 5:
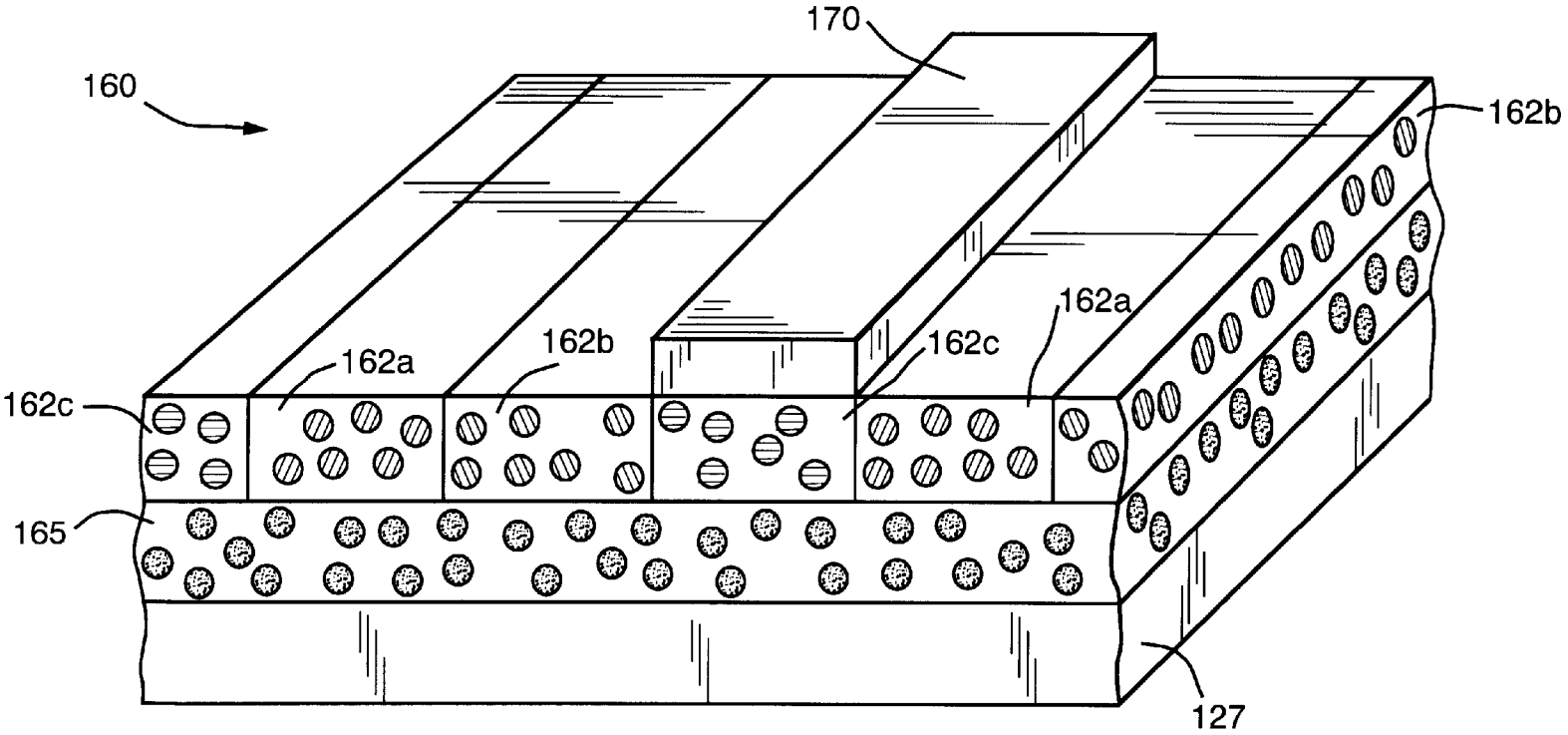
FIG. 5 is a partial isometric view of a recording member utilizing adjacent color stripes to represent color, and including a stripe for registering a suitable writing head.

Refer now to FIGS. 3–5, which illustrate constructions capable of recording full-color images. The construction 125 shown in FIG. 3 operates in a subtractive mode, and comprises a reflective or white substrate (e.g., reflective aluminum or a white reflective film). A differently colored thermochromic composition is dispersed in each of adjacent layers 129, 131, 133, which overlie substrate 127. Each of the layers is separately "addressable," i.e., can be made to undergo a transition independent of the other layers. The colors of layers 129, 131, 133 collectively form a subtractive color gamut, such as the well-known CMY (cyan/magenta/yellow) gamut, that facilitates production of a broad range of colors through subtractive combination of the constituent (primary) colors.

Preferably, separate addressability is obtained by using thermochromic compositions that undergo transition to transparency at elevated temperatures, and colors whose complements exhibit little or no spectral overlap. In this way, exposing the composition of any particular color to light of its complement results in substantial energy absorption by that composition, but not by the other compositions. The transition temperatures of the thermochromic compositions are chosen to facilitate convenient imaging—that is, adequate energy absorption to ensure transition through exposure to light from the desired imaging modality.

In one approach, the construction 125 is imaged by imagewise exposure by three laser sources (or a single tunable source) each tuned to the wavelength corresponding to color complements of the layers 129, 131, 133. The lasers scan over the surface of the construction 125 and create a pattern of colored dots corresponding to the source image by imparting energy that selectively deletes (renders transparent), at each image point, one or more of layers 129, 131, 133 to achieve the appropriate color (on a subtractive basis) for that point. In particular, utilizing thermochromic compositions that become transparent in response to exposure to light of a complementary color, it should be apparent that a source image can be transferred to the recording member 125 by exposing it to light patterns embodying the source image itself. Accordingly, in addition to pointwise, computer-controlled laser exposure, recording member 125 can be exposed thermo-optically, e.g., by projecting the image onto the surface S of the construction (using, for example, a simple slide projector, photographic enlarger, television projector, digital mirror device, etc.).

A gray-scale effect can be added to this embodiment by utilizing compositions having different transition temperatures for each color; these different compositions can be dispersed within the same color layer or in different, adjacent layers. Longer or more intense exposures times result in deletion of more of the composition (e.g., a greater number of pigment particles), since longer exposures produce higher temperatures which, in turn, affect a larger variety of the differently responsive (but similarly colored) particles.

Refer now to FIG. 4, which illustrates an additive approach to reversible rendition of color. Instead of multiple, one-color layers, the construction 138 comprises a single layer 140 containing a dispersion of differently colored pigments (or dyes) 142, 144, 146 forming an additive color gamut, since the pigment particles are spaced so closely together that the eye integrates the colors of neighborhoods of particles. A representative set of additive colors is red, green and blue. Substrate 127 need not be reflective, but is typically white to maintain an adequate brightness level or color "value."

Imagewise exposure of the recording member 138 to colored light results in deletion of pigment particles complementary to the colors impinging on layer 140 at any point. Accordingly, construction 138 may imaged in the same manner as construction 125—through pointwise opto-thermal exposure by one or more laser sources, or by simple projection. The heating of each particle is self-limiting; as it becomes transparent, a particle ceases to absorb heat and rise in temperature. Accordingly, exposure of one particle is unlikely to cause unwanted, spurious transition of neighboring particles unaffected by the applied light.

Once again, multiple gray-scale levels can be obtained by using multiple layers 140, each with a dispersion of thermochromic compositions forming an additive color gamut, but with transition temperatures that vary among layers. Additionally or in lieu thereof, a layer containing a dispersion of a black thermochromic composition can be sandwiched between layer 127 and the overlying layer 140. This layer can be selectively rendered transparent to provide control over the color value, and is addressable independently of the thermochromic compositions in layer 140 (that is, due to the self-limiting nature of the imaging process, heating of compositions in the overlying layer 140 will not inadvertently result in activation of the black composition or vice versa). In one preferred approach, a black pigment has a transition temperature lower than that of any of the pigments in overlying layer 140, and so may be selectively addressed without effect on layer 140.

FIG. 5 illustrates an alternative approach to additive color rendition. A recording member 160 comprises a series of consecutive triplets of rows or stripes 162*a*, 162*b*, 162*c*, each having dispersed therein a thermochromic composition of a different color, with the colors collectively forming an additive color gamut. The stripes 162*a*, 162*b*, 162*c* are contiguous with respect to one another and sufficiently narrow (on the order of 170 microns per individual stripe for a 50 dpi triad to 14 microns per stripe for a 600 dpi triad) that the eye integrates their colors. Selective deletion of corresponding portions of adjacent strips facilitates production of any color of the gamut.

In other words, an image point or pixel of recording member 125 or 138 may be represented by any selected unit area of the member (so long as, in the case of pigment compositions, the area is large relative to the size of a pigment particle), since the layers overlie one another. An image point or pixel in construction 160, on the other hand, must include similarly sized, adjacent portions of a three-stripe triplet. Ordinarily, the pixel extends longitudinally along the stripes a distance equal to the lateral width of the triplet.

Underlying the stripes is a substrate 127 (typically white) and, if desired, an additional layer 165 containing a dispersion of a black thermochromic composition. Once again, this layer can be selectively rendered transparent to provide control over the color value, and is addressable independently of the compositions in the overlying color stripes. In one preferred approach the black composition has a transition temperature lower than that of any of the colored compositions in the stripes.

Recording member 160 is most readily imaged using a single thermal or laser writing head of conventional design but capable of addressing a single stripe. With this approach, it is critical to provide a reliable mechanism for orienting the device over a desired stripe (or stripes) at a selected pixel location. In the preferred embodiment, this is accomplished by a registration stripe 170, which is coated or laminated onto a stripe of a selected color (in the figure, registration stripe 170 overlies a colored stripe 162*c*). Ordinarily, recording member 160 contains a single stripe 170 overlying the marginal color stripe; however, a plurality of registration stripes 170 can be distributed over member 160 (as suggested in FIG. 5) for purposes of verifying proper orientation of the writing head during imaging. Registration stripe 170 is transparent to visible light, but absorbs or reflects invisible wavelengths (e.g., in the infrared or ultraviolet spectral regions). For example, plastics such as polymethylmethacrylate, while transparent in the visible region of the spectrum, exhibit characteristic absorption lines in the infrared (typically around 725 and 850 nm) and ultraviolet regions. Accordingly, the return signal amplitude will be higher when the radiation returns directly from the surface of the colored stripes, without the diminution from absorption by layer 170. By registering deviations in signal amplitude from a suitably equipped thermal writing head, a controller governing movement of the head can straightforwardly locate stripe 170.

Figure 6:
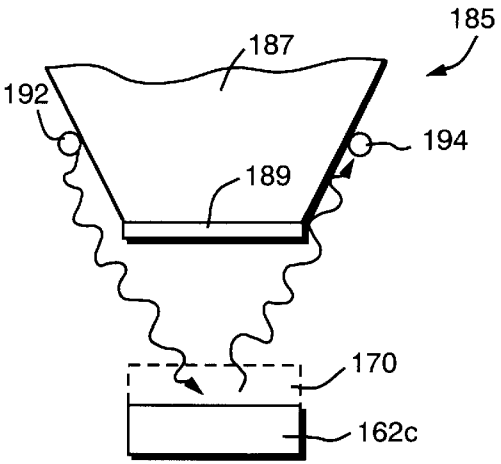
FIG. 6 schematically depicts a writing head useful in imaging the construction illustrated in FIG. 5.

An exemplary writing head is shown in FIG. 6, and includes a trunk segment 187 terminating in a heating element 189 that is no wider than any of the stripes 162*a*, 162*b*, 162*c*, extending longitudinally the length of one pixel. On one lateral side of trunk 187 is a radiation-emitting element (e.g., a diode) 192; on the other side is a detector element 194 capable of detecting the radiation produced by element 192 and producing an electrical signal proportional thereto. Using suitable scanning arrangements (such as lead screws and associated stepper motors), writing head 185 is indexed, stripe by stripe, along construction 160 and activated in an imagewise pattern according to stored image data. Initially, writing head 185 is moved into proximity to an edge of the recording member 160, and is stopped when element 194 detects registration stripe 170 (signifying that the element 189 overlies the marginal colored stripe). The head is then indexed so as to complete a full scan of non-overlapping image points. If construction 160 includes a series of interspersed registration stripes 170, the assumed position of writing head 185 can be assessed against its actual position by determining whether signals from element 194 are detected at expected locations.

Figure 7:
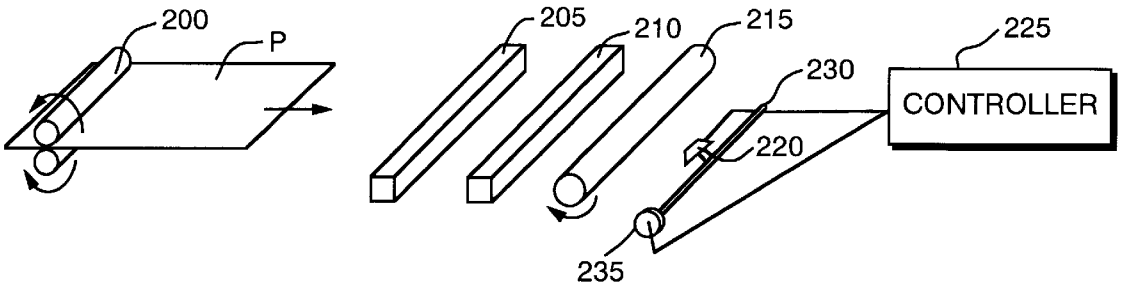
FIGS. 7 and 8 schematically depict recording apparatus for imaging the various constructions shown and described herein.
Figure 8:
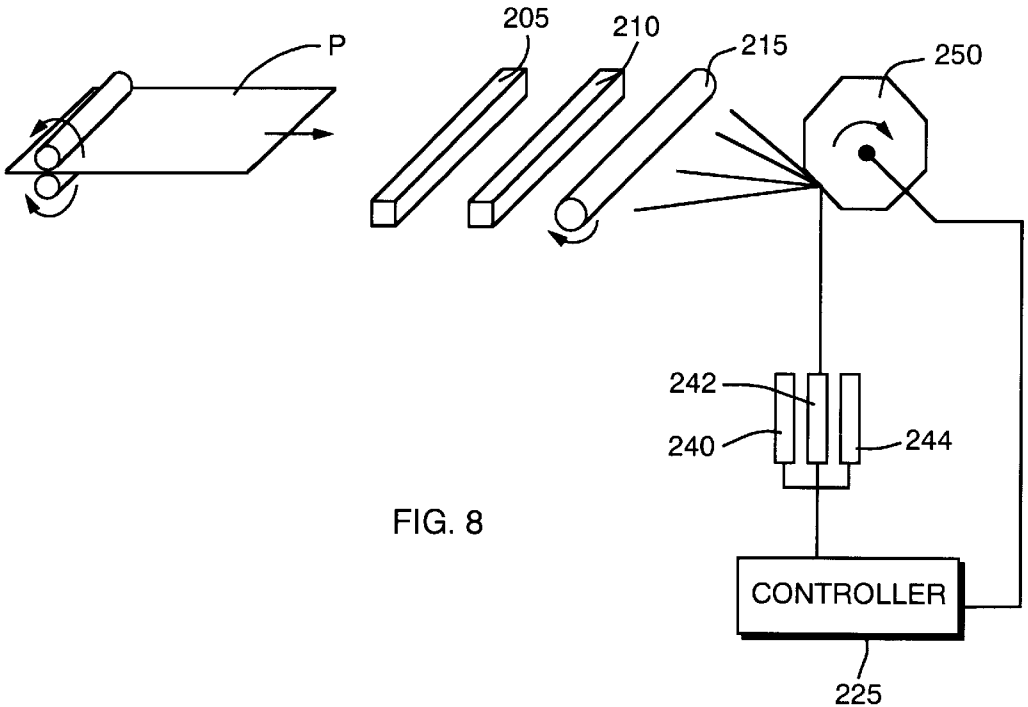

Refer now to FIGS. 7 and 8, which depict thermal printing apparatus useful in imaging the foregoing constructions, and which are particularly suited to recording sheets incorporating thermochromic materials that exhibit hysteresis. The embodiment shown in FIG. 7 is amenable to imaging gray-scale monochrome images on recording members 100 or 115, as well as colored images on a construction such as member 160 (or member 125, if the various layers exhibit different transition temperatures). The apparatus includes a conventional paper feeding and conveying mechanism, denoted generically at 200, which conducts a sheet of paper P among the various other elements of the apparatus. The sheet P is initially brought into contact with or proximity to a first heating or cooling element 205, followed by a second heating or cooling element 210. Preferably, the invention operates with recording members designed to undergo a forward transition (e.g., to a transparent state) above room temperature, and a reverse transition (e.g., to a colored state) below room temperature. In this case, element 205 is a preheating element (preferably resistive) that heats sheet P to a temperature above the forward transition temperature, and element 210 is a cooling element (e.g., Peltier element or a solid-state cooler) that cools sheet P to a temperature below the reverse transition temperature. The result of this cumulative exposure is eradication of any spurious hysteresis, or hysteresis persisting from previous uses of sheet P, resulting in a clean final image.

The conditioned sheet P is then engaged to a rotating drum 215, where it is selectively exposed to the action of a variable-temperature thermal writing head 220 (which may be configured, for example, in the manner shown in FIG. 6). The imaging apparatus is thus implemented as a scanner or plotter, with writing head 220 positioned over the working surface of the sheet P and moved relative thereto so as to collectively scan the surface. The operation of writing head—that is, its instantaneous temperature during the scan—is controlled by an incoming stream of picture signals, which constitute an electronic representation of an original document or picture. The signals can originate from any suitable source such as an optical scanner, a disk or tape reader, a computer, etc.

More specifically, a controller 225 receives these signals and controls the operation of writing head 225. This is accomplished, for example, by mounting writing head 220 for movement along a lead screw 230 (e.g., by means of a bracket that rides along a parallel guide bar, not shown). When the lead screw is rotated by a stepper motor 235, writing head 220 is moved axially with respect to sheet P. Both the heat emitted by writing head 220 and its movement by stepper motor 235 are controlled by controller 225, which receives signals from stepper motor 220 that record the axial progress of writing head 220 and a shaft encoder (not shown) associated with drum 215 that records its rotation. As a result, controller 220 "knows" the instantaneous relative position of writing head 220 and sheet P at any given moment. The control circuitry required to accomplish this is very well known in the scanner and plotter art.

As the scan proceeds, controller 225 relates the position of writing head 220 to the stored image data, activating writing head 220 at appropriate points and causing heating of sheet 220 to appropriate pointwise temperatures so as to impose thereon a gray-scale image corresponding to the image represented by the data. When the sheet has been fully imaged, it is ejected from the apparatus.

FIG. 8 illustrates a different version of the embodiment illustrated in FIG. 8, and which has been modified to facilitate imaging of the recording members 125 or 138. A series of light sources 240, 242, 244, the operation of which is controlled by controller 225, are directed toward a scanning element 250 (also operated by controller 225) which directs the light of any of the sources to any axial point along drum 215; in this way, any point on the rotating sheet P can be addressed by any of the light sources 240, 242, 244 during the course of a scan.

The colors of light emitted by sources 240, 242, 244 are complementary to the colors of the pigments used in the recording member. As sheet P is rotated on drum 215, controller 225 selectively activates sources 240, 242, 244 and orients element 250 so as to create a pattern of colored dots corresponding to the source image by imparting energy that selectively deletes, at each image point, the appropriate color (on an additive or a subtractive basis) for that point.

It will therefore be seen that the foregoing represents a highly efficient and advantageous approach to reversible color and gray-scale imaging. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed. For example, all of the recording members disclosed herein can include transparent protective layers above the recording layer to prevent scratching or other handling damage.

What is claimed is:

1. A method of printing an image onto a thermochromic recording sheet, the image being represented by an array of encoded image points each having a color, the method comprising the steps of:

a. providing a recording member comprising a layer having uniformly dispersed therein a plurality of reversible, colored thermochromic compositions, each composition entering a transparent state upon heating to a decoloration temperature greater than room temperature and entering a colored state upon cooling to a coloration temperature below room temperature, the compositions persisting in a pre-existing state at room temperature and collectively forming an additive color gamut;

b. providing a heating source for selectably heating the compositions according to color;

c. causing relative movement between the heating source and the recording member to effect a scan of the recording member by the heating source; and d. actuating the heating source in an imagewise pattern during the course of the scan so as to record the image onto the recording member, the heating source, when actuated, causing at least one of the compositions to enter the transparent state, thereby creating an array of colored points corresponding to the image-point array.

2. The method of claim 1 wherein the colors are red, green and blue.

3. A method of printing an image onto a thermochromic recording sheet, the image being represented by an array of encoded image points each having a color, the method comprising the steps of:

a. providing a recording member comprising a layer having uniformly dispersed therein a reversible thermochromic material comprising differently colored thermochromic compositions forming an additive color gamut, each composition becoming transparent upon heating to a decoloration temperature greater than room temperature and entering a colored state upon cooling to a coloration temperature below room temperature;

b. providing an activation source for selectably activating the compositions according to color;

c. causing relative movement between the activation source and the recording member to effect a scan of the recording member by the activation source; and d. actuating the activation source in an imagewise pattern during the course of the scan so as to record the image onto the recording member, the activation source, when actuated, rendering the composition of at least one selected color transparent by exposing the recording member to the color complement, thereby heating the composition of the selected color, but not other compositions, to the decoloration temperature, thus creating an array of colored points corresponding to the image-point array.

4. A method of printing an image onto a thermochromic recording sheet, the image having a gray scale and being represented by an array of encoded image points each having a color, the method comprising the steps of:

a. providing a recording member comprising multiple layers each having uniformly dispersed therein a thermochronic material, the material becoming transparent upon activation and comprising differently colored thermochromic compositions forming an additive color gamut, and the thermochromic material of each layer undergoing activation at a different temperature;

b. providing an activation source for selectably activating the compositions according to color;

c. causing relative movement between the activation source and the recording member to effect a scan of the recording member by the activation source; and d. actuating the activation source in an imagewise pattern during the course of the scan so as to record the image onto the recording member by rendering the composition of at least one selected color of at least one layer transparent, thereby creating an array of colored points corresponding to the image-point array in color and gray scale.

5. A method of printing an image onto a thermochromic recording sheet, the image being represented by an array of encoded image points each having a color, the method comprising the steps of:

a. providing a recording member comprising a reflective substrate and, thereover, a plurality of layers each having uniformly dispersed therein a thermochromic composition, the composition becoming transparent upon heating to a decoloration temperature greater than room temperature and entering a colored state upon cooling to a coloration temperature below room temperature, and each layer comprising a differently colored material collectively forming a subtractive color gamut;

b. providing an activation source for selectably activating at least one of the layes according to color;

c. causing relative movement between the activation source and the recording member to effect a scan of the recording member by the activation source; and d. actuating the activation source in an imagewise pattern during the course of the scan so as to record the image onto the recording member, the activation source, when actuated, heating adjacent portions of at least one selected layer so as to render the at least one selected layer transparent, thereby creating an array of colored points corresponding to the image-point array.

6. The method of claim 5 wherein the colors are cyan, magenta and yellow.

7. The method of claim 5 wherein the activation source renders transparent the composition of a selected color by exposing the recording member to the color complement, thereby heating the composition of the selected color, but not other compositions, to the decoloration temperature.

8. A method of printing an image onto a thermochromic recording sheet, the image having a gray scale and being represented by an array of encoded image points each having a color, the method comprising the steps of:

a. providing a recording member having a plurality of layers, each layer of the recording member comprising a plurality of thermochromic compositions having the same color but a different activation temperature;

b. providing an activation source for selectably activating the compositions according to color;

c. causing relative movement between the activation source and the recording member to effect a scan of the recording member by the activation source; and d. actuating the activation source in an imagewise pattern during the course of the scan so as to record the image onto the recording member by rendering a selected number of the compositions of at least one selected color transparent, thereby creating an array of colored points corresponding to the image-point array in color and gray scale.

9. A method of printing an image onto a thermochromic recording sheet, the image having a gray scale and being represented by an array of encoded image points each having a color, the method comprising the steps of:

a. providing a recording member having a plurality of layers, each layer comprising multiple sets of recording sublayers, the sublayers of each set each comprising a thermochromic composition of the same color but having a different activation temperature;

b. providing an activation source for selectably activating the compositions according to color;

c. causing relative movement between the activation source and the recording member to affect a scan of the recording member by the activation source; and d. actuating the activation source in an imagewise pattern during the course of the scan so as to record the image onto the recording member by rendering a selected number of the sublayers of at least one selected set transparent, thereby creating an array of colored points corresponding to the image-point array in color and gray scale.

10. A method of printing an image onto a thermochromic recording sheet, the image being represented by an array of encoded image points each having a color, the method comprising the steps of:

a. providing a recording member comprising (i) a layer having a plurality of contiguous sets of stripes, each set comprising a plurality of contiguous stripes each having uniformly dispersed therein a differently colored thermochromic material, the stripes being sufficiently narrow to be visually integrated and collectively forming an additive color gamut, and (ii) an edge and a marginal stripe along the edge, the marginal stripe comprising a detection signal;

b. providing an activation source for selectably activating the stripes according to color;

c. orienting the activation source above the marginal stripe using the detection signal;

d. causing relative movement between the activation source and the recording member to effect a scan of the recording member by the activation source; and e. actuating the activation source in an imagewise pattern during the course of the scan so as to record the image onto the recording member, the activation source, when actuated, rendering the composition of at least one adjacent stripe transparent, thereby creating an array of colored points corresponding to the image-point array.

11. The method of claim 10 wherein the detection signal comprises a detection stripe overlying the marginal stripe, the detection stripe comprising a material substantially transparent to visible light but absorbing invisible radiation of a characteristic wavelength, the activation source comprising a source of radiation including the characteristic wavelength and oriented toward the recording member, and a detector for detecting radiation reflected from the recording member, and the orienting step comprising moving the activation source toward the marginal stripe while detecting reflected radiation and stopping movement upon detection of a diminished amount of reflected radiation.

* * * * *